US005275073A

United States Patent [19]

Zemlak et al.

[11] Patent Number: 5,275,073

[45] Date of Patent: Jan. 4, 1994

[54] FILM DISPENSER

[75] Inventors: William A. Zemlak, Richmond; Frank Li, Vancouver; Greg H. Russell, Surrey; Tony Mark, Burnaby; Rick Chiu, Surrey, all of Canada

[73] Assignee: Quick-Wrap Industries, Inc., Canada

[21] Appl. No.: 978,273

[22] Filed: Nov. 18, 1992

[51] Int. Cl.[5] ..... B26D 7/10; B26F 3/12

[52] U.S. Cl. ..... 83/171; 83/175; 83/649; 225/20

[58] Field of Search ..... 83/171, 175, 649, 651.1; 225/7, 20, 39

[56] References Cited

U.S. PATENT DOCUMENTS

| | | | |
|---|---|---|---|
| 1,121,062 | 12/1914 | Bauer | 225/39 X |
| 1,231,415 | 6/1917 | Nebergall . | |
| 1,358,904 | 11/1920 | Welch . | |
| 2,232,968 | 2/1941 | Price et al. | 225/39 X |
| 2,924,493 | 2/1960 | Preble . | |
| 2,969,169 | 1/1961 | Botnick | 225/43 |
| 3,131,278 | 4/1964 | Rosenthal . | |
| 3,134,005 | 5/1964 | Mayhew | 83/171 |
| 3,595,456 | 7/1971 | Rosenthal | 225/11 |
| 3,707,251 | 12/1972 | Dashnier et al. | 225/21 |
| 3,713,569 | 1/1973 | Dashnier et al. . | |
| 3,731,863 | 5/1973 | Nausedas | 225/20 |
| 3,782,615 | 1/1974 | Webster et al. | 225/94 |
| 4,018,034 | 4/1977 | Keren . | |
| 4,156,382 | 5/1979 | Baker | 83/649 X |
| 4,427,144 | 1/1984 | Macgrory et al. | 225/7 |

*Primary Examiner*—Eugenia Jones

*Attorney, Agent, or Firm*—Joseph W. Berenato, III

[57] ABSTRACT

A film dispenser having a housing with side and bottom walls, a film roll receptacle and a ledge located forwardly of the receptacle. A heating wire is mounted transverse to the direction of movement of film from the film roll when mounted in the film roll receptacle. A power supply is coupled to the output lines in series with said heating wire. A switch is mounted on the housing in series with the power supply and the heating wire and is operative upon closing to permit the passage of electrical current through the wire. An elongated channel piece is pivotally mounted such that the pivot point is movable to a limited extent and, in response to pulling up film from the film roll, the movement of the channel piece causes the switch to close and at the same time pinches the film against the housing. Upon being released, the channel piece causes the opening of the switch and removes substantially all of the pinching effect. A guard mounted to the housing covers the heating wire and, in response to pressure from said film moves upwardly so as to expose the heating wire and allow the film to contact the wire. There is no need to mount the film roll on sockets in the film roll receptacle as in prior devices.

10 Claims, 4 Drawing Sheets

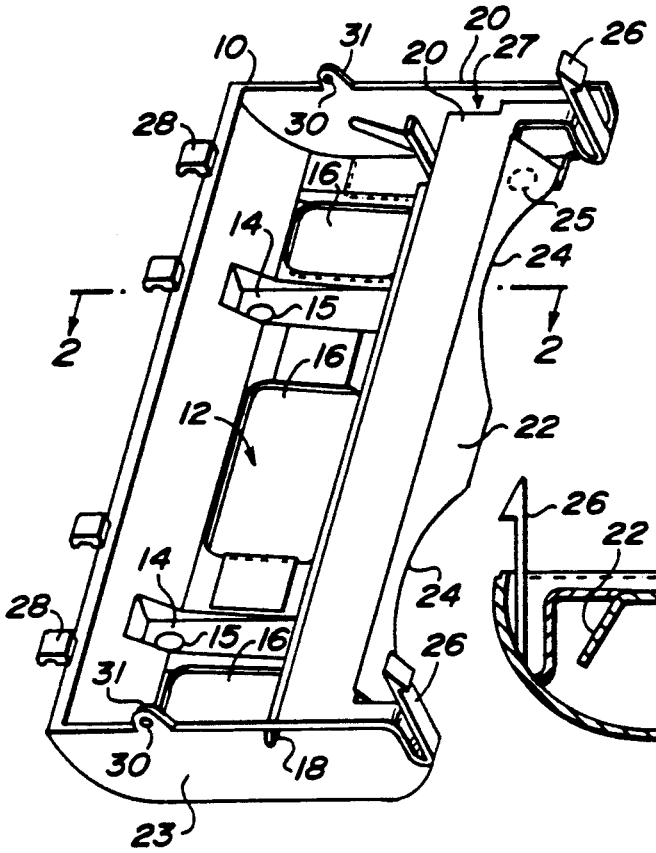
FIG. 1
FIG. 2
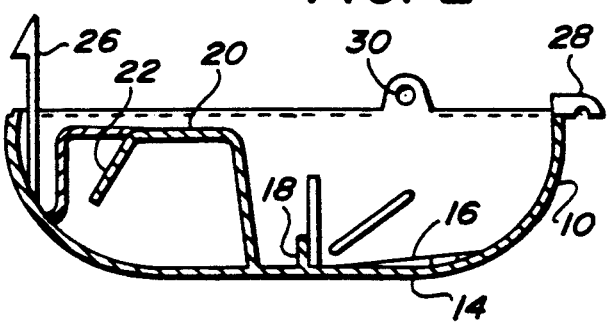
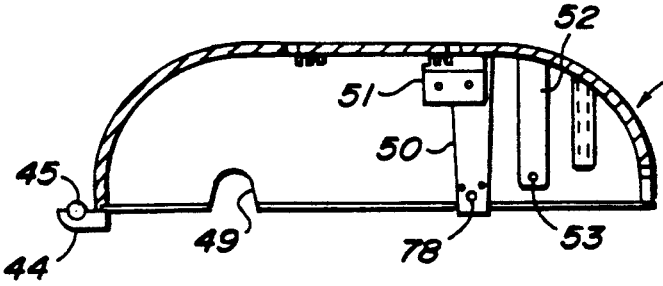
FIG. 4
FIG. 5
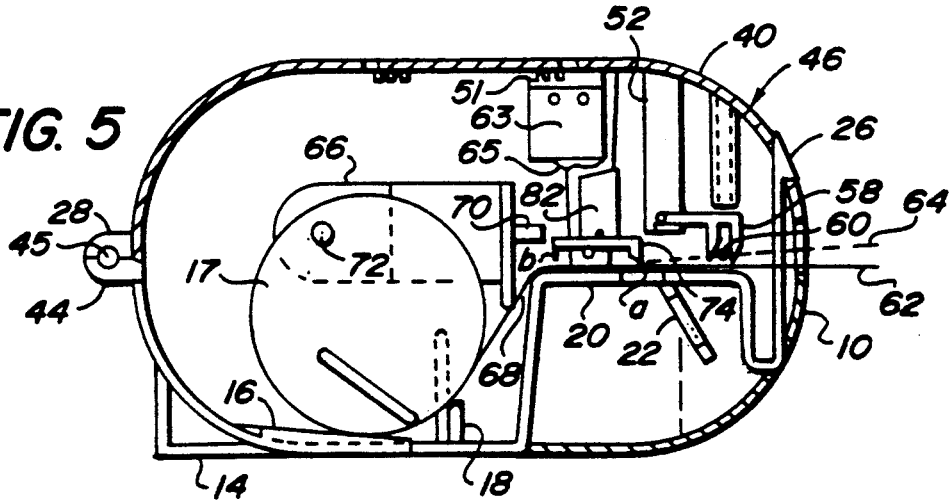

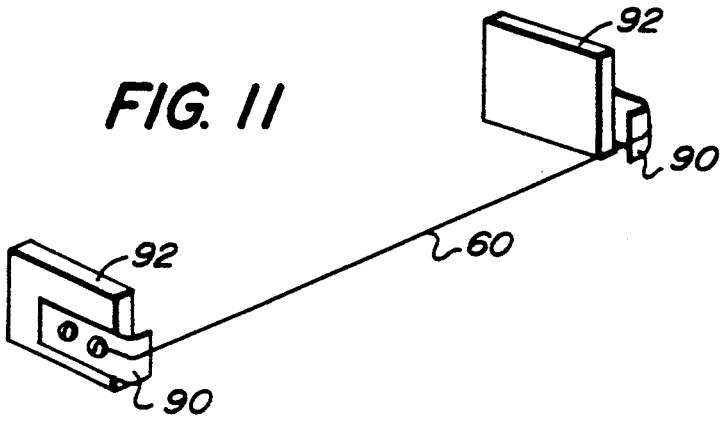
FIG. 11
FIG. 12
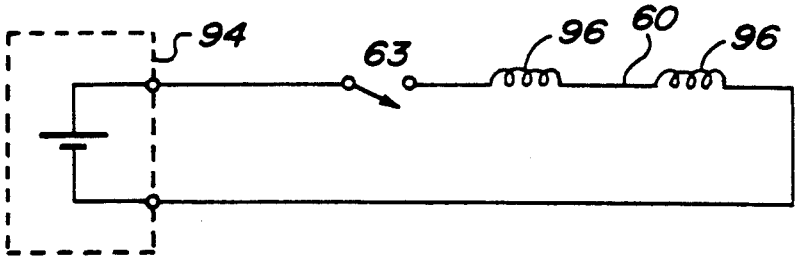
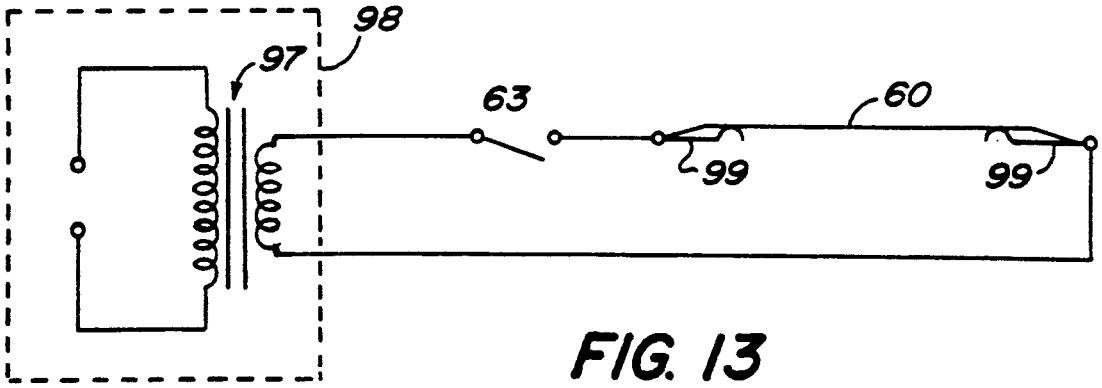
FIG. 13

FILM DISPENSER

BACKGROUND

The present invention relates to a film dispenser for dispensing film such as that used in the packaging of food from a roll of such film.

Known film dispensers include a rotatable support around which a roll of sheet material is stored and a serrated elongated edge mounted at the mouth of a dispensing aperture. It is common with such dispensers to accidentally cut ones finger on the serrated edge during the film cutting or severing step. Another problem occurs once the severing step has been completed. Typically the serrated edge faces down from the top elongated edge of the mouth. Thus, in order to sever the film it is necessary to lift up and tear it from one side to the other. The latter action results in the film wrapping around on itself making it difficult to unwrap and straighten.

One method developed to overcome the latter problem is disclosed in Wallace J. Macgrory et al. U.S. Pat. No. 4,427,144 issued on Jan. 24, 1984 and assigned to EZY Wrap Products Pty. Limited of Australia. The Macgrory patent discloses the use of a heated wire to melt the film along a direction transverse to its direction of movement when being unravelled. The power applied to the wire heats it up until its reaches equilibrium with its surroundings and its temperature stabilizes. Usually the temperature of the wire is so high that it burns the film and causes the release of noxious fumes.

A solution to the overheating of the wire is disclosed in an earlier patent, namely H. Rosenthal U.S. Pat. No. 3,595,456 issued Jul. 27, 1971. The Rosenthal patent discloses the use of a heated wire in combination with a pivotal wire switch actuator which closes a normally open switch upon being forced to pivot upwardly by the film. The same actuator causes the switch to open after severance of the film by the heated wire is complete and shut off the current.

The above-mentioned Rosenthal patent also discloses a brake for restraining the film roll from unwinding during severance of the film. The brake consists of a manually operated solenoid that causes an elongated rod to engage a serrated disc affixed to the roller which supports the roll of film. The latter brake structure is complex and requires manual operation of a lever once the desired length of film has been withdrawn.

Most commercial endeavors to manufacture and market film dispensers have been unsuccessful due primarily to the inconvenience and lack of reliability of the products. Clearly, it is desirable to have a film dispenser with a minimum number of parts in order to minimize the cost and the likelihood of component failure. At the same time provision must be made for preventing the roll from unwinding once a desired length of film has been extracted. Also electrical heating of a wire should be used to avoid the injury that mechanical serrations can inflict and yet the heating must not produce noxious fumes while at the same time be able to sever a film of varying thickness without adjustment. Finally, the film end must be conveniently disposed after severance so that it may be grabbed and pulled out to a desired length.

Accordingly, a principal object of the invention is to provide an improved film dispenser that is simpler in construction and more reliable than previous film dispensers. A further object is to provide a film dispenser with a simple brake system that is easy to load.

SUMMARY OF THE INVENTION

According to the invention there is provided a film dispenser which includes a housing having side and bottom walls and a film roll receptacle and a ledge forwardly of the receptacle. A heating wire is mounted transverse to the direction of movement of film from the film roll when mounted in the film roll receptacle. A power supply having output lines in series with said heating wire provides the electrical current to heat the heating wire. A switch is mounted on the housing in series with the power supply and the heating wire and is operative upon closing to permit the passage of electrical current through the wire. An elongated member is pivotally mounted such that the pivot point is movable and, in response to pulling up film from the film roll, the member contacts and closes the switch. At the same time the elongated member pinches the film against the housing so as to restrain its movement out of the dispenser. Upon being released, the elongated member releases the film and removes substantially all of the pinching effect.

The film roll receptacle may include a bottom inclined downwardly and forwardly of the roll so as to stop forward rolling of the roll in such a way that film from the roll may be pulled forwardly.

The elongated member may have a downwardly depending elongated side edge and may be suspended at pivot point forwardly of the side edge The member may be movable upwardly in response to pressure from the film upon being lifted so as to close the switch while the side edge pinches the film against an underlying ledge.

Preferably, the elongated channel member opens the switch upon movement back towards its rest position.

The wire may be mounted over two spring biased levers located at respective sides of the housing.

The guard may be positioned such that upon severance of the film, it moves downwardly and pushes the severed film off of the wire.

The housing may include a roll abutment on a bottom of housing positioned to block the forward rolling of the film roll in combination with the roll stop.

Preferably, the housing consists of a top housing and a bottom housing removable connectable to each other, with the bottom housing having a roll receptacle, the roll stop and ledge. The top housing has the channel piece, the heated wire, the switch and the guard.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

FIG. 1 is perspective view of the lower half of the dispenser housing;

FIG. 2 is a side elevation view in section of the dispenser of FIG. 1 taken along the line 2—2;

FIG. 4 is a side elevation view in section of the top of FIG. 3 taken along the line 4—4;

FIG. 5 is a side elevation view in section showing the top and bottom halves of the housing assembled;

FIG. 11 is a perspective view showing the mounting arrangement for the heating wire;

FIG. 12 is a circuit diagram with the heating wire suspended between two coil springs; and FIG. 13 is a circuit diagram showing the heating wire tensioned by two leaf springs.

DETAILED DESCRIPTION WITH REFERENCE TO THE DRAWINGS

Figure 3:
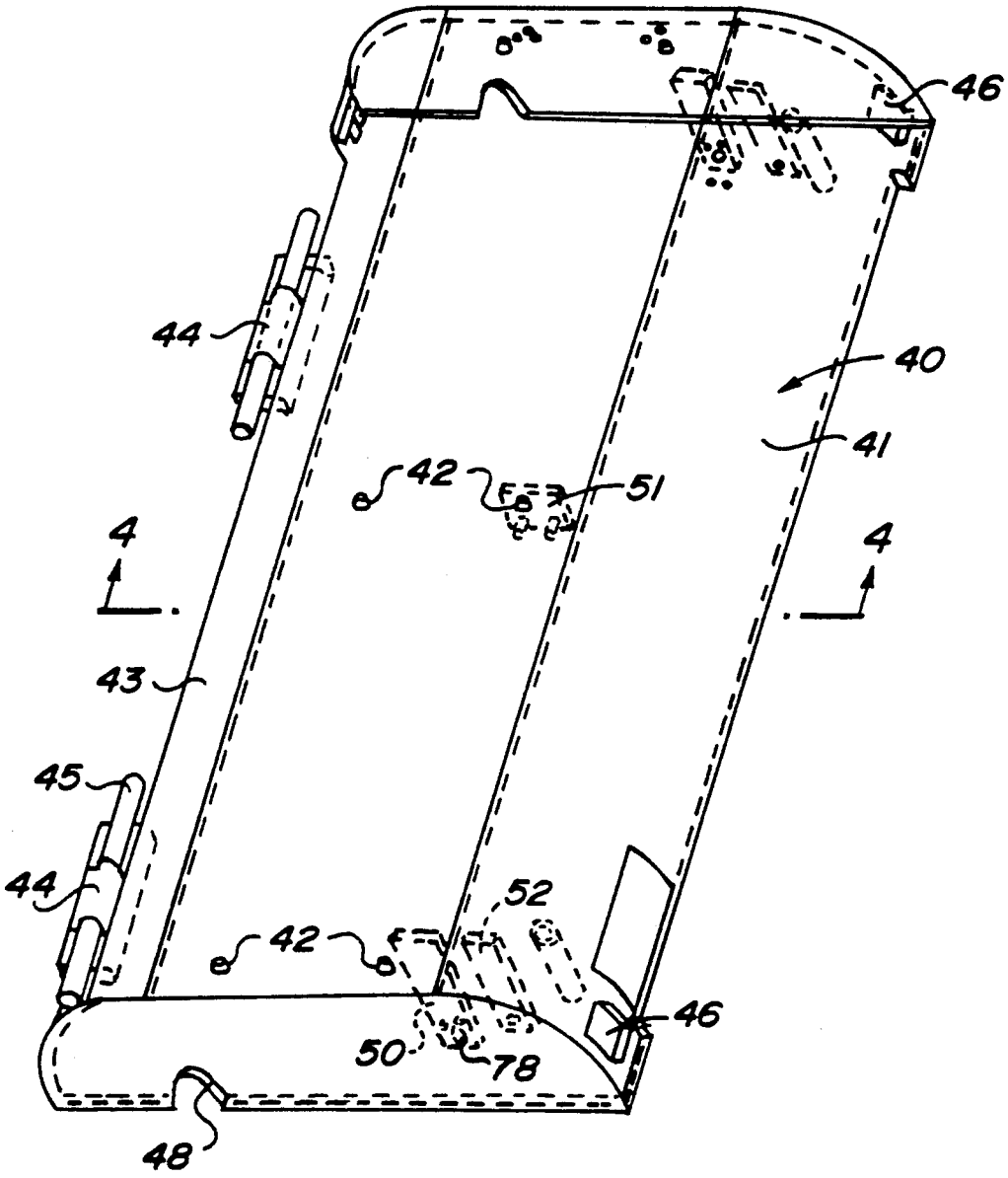
FIG. 3 is a perspective view of the top half of the housing.

Referring to FIGS. 1 and 2 there is shown a film dispenser bottom housing 10 having a film receptacle 12. The film receptacle 12 has three forwardly and downwardly inclined bottom plates 16 and a roll abutment 18 at a forward end of the receptacle 12. A Forwardly of the roll abutment there is located a ledge 20 having a forwardly and downwardly inclined extension 22 with two recessed regions 24. A pair of upright flexible catches 26 are located on either side of the front of the housing 10.

Recessed below the plates 16 are two support pads 14 having knockouts 15 for screw mounting to a horizontal flat surface (not shown). At the rear periphery of the housing 12 there are four brackets 28 having a rounded lower side for mating contact with a rounded bars 45 affixed to an upper housing 40 (see FIG. 3). At either side of housing 10 there is a lobe 31 having a hole 30 projecting up from the side panel 23. Ledge 20 has a cut away portion 27 at either side to give access to a knockout 25 on the bottom of housing 10.

Referring to FIGS. 3 and 4 there is shown a top housing 40 having rounded front and back regions 41 and 43, respectively. A plurality of knockouts 42 on the top allow the top housing to be screwed to the underside of a cupboard or other support surface if desired. A pair of downwardly depending brackets 50 located at either side depend downwardly from the top of housing 40 over ledge 20 and have a rounded slot 78 at a lower end thereof. A second set of brackets 52 located forwardly from brackets 50 have a hole 53 at a lower end thereof.

At the front of housing 40 there are two rectangular openings 46 which receive catches 26 when top housing 40 and bottom housing 10 are engaged. At the sides of housing 40 are two rounded notches 48 which are positioned to receive lobes 31 At the rear of housing 40 there are two bracket assemblies 44 to which are affixed rounded bars 45 that extend out either side of the brackets 44.

Figure 10:
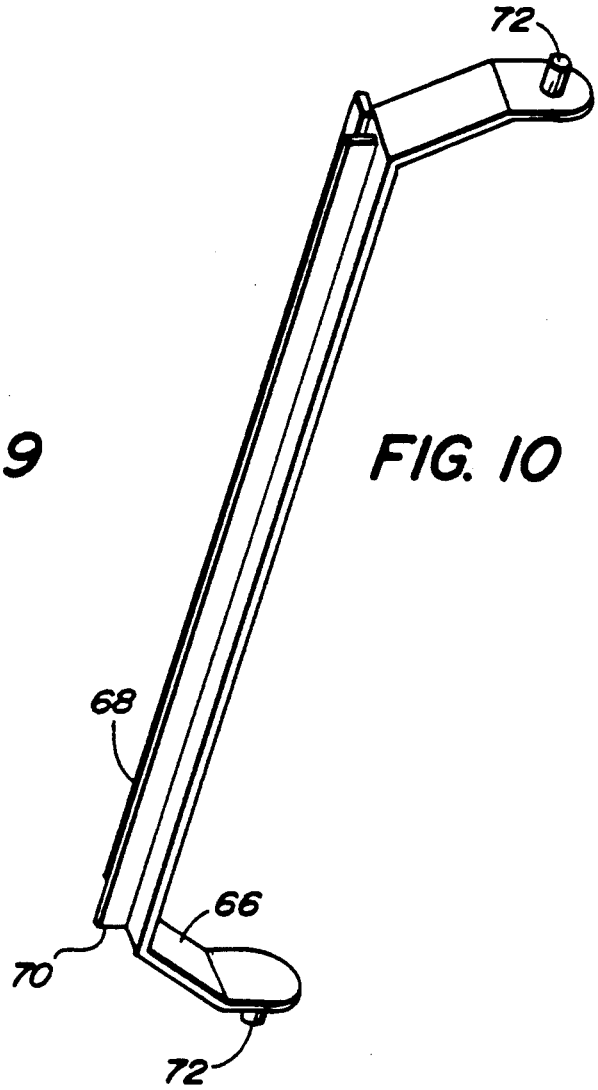
FIG. 10 is perspective view of a roll stop.

Referring to FIG. 5 there is shown the complete assembly with top 40 and bottom 10 housings connected. Brackets 28 on bottom housing 10 fit over the portions of rounded bars 45 which project outwardly of brackets 44. A roll of film 17 is positioned on plates 16 abutting roll abutment 18 with the end of the film 62 passing over ledge 20 and out of the front of the assembly. Ordinarily end 62 drapes over extension 22. A roll stop 66 shown in more detail in FIG. 10 has a pair of round studs which slidably engage holes 30 in lobes 31. The forward end of roll stop 66 consists of a film contacting elongated rectangular plate 68 and an orthogonal elongated plate 70 affixed to plate 68. The lower end of plate 68 contacts film 62 and, together with abutment 18 stops roll 17 from forward movement during withdrawal of film 62. Plate 70 rests on ledge 20 at the lowest extent of movement of stop 66. Plate 68 assists in tensioning film 62 during withdrawal.

Figure 6:
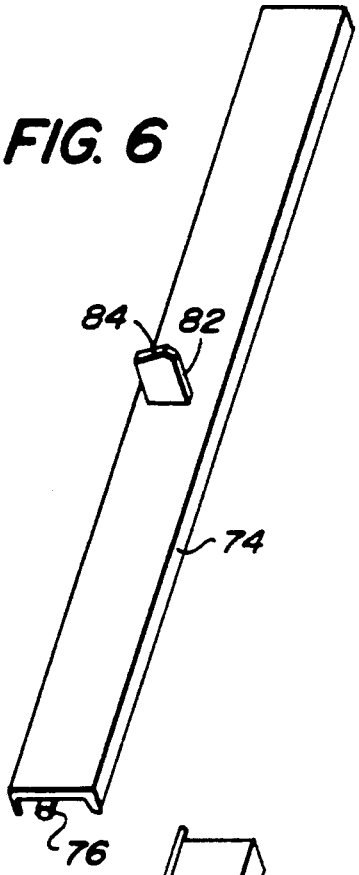
FIG. 6 is a perspective view of the channel element.
Figure 7:
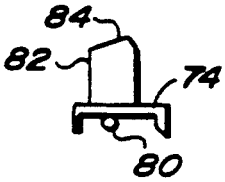
FIG. 7 is an end view of the channel element.
Figure 8:
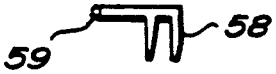
FIG. 8 is an end view of the pivotal guard for the heated wire.

An elongated channel piece 74 shown in more detail in FIGS. 6 and 7 has a pair of rounded studs 80 which are slidably received by slots 78 in brackets 50. An outwardly projecting plate 82 centrally fixed to channel piece 74 has a cam surface 84 on its outermost periphery. Above cam surface 84 there is mounted to a bracket 51 a switch 63 having a movable contact 65 Cam surface 84 pushes contact 65 upwardly upon pivoting of channel piece 74 counterclockwise as shown. Switch 63 turns the current through a heating wire 60 on and off in response to pivoting counterclockwise and back, respectively.

Figure 9:
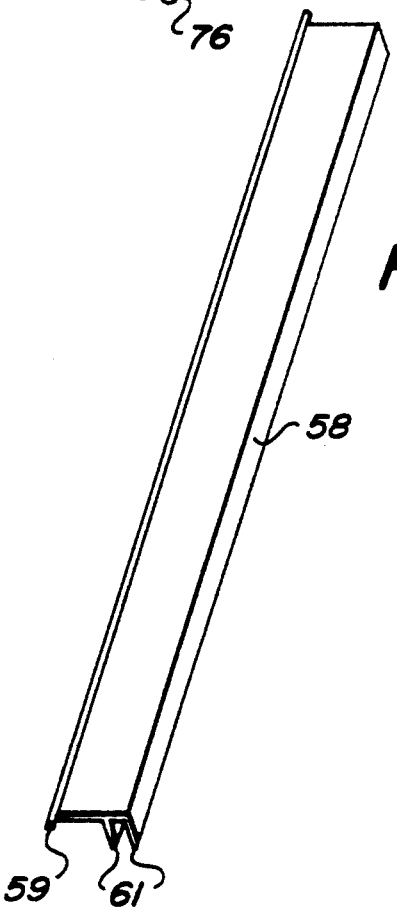
FIG. 9 is a perspective view of the guard.

A guard 58 shown in detail in FIG. 9 has studs 59 which are slidably received by holes 53 in bracket 52. Guard 58 has a pair of spaced apart parallel elongated strips 61 which enclose a heating wire 60 when pivoted down to rest on ledge 20. On pulling up on film edge 62 to bring it to the position shown by the dotted lines 64, guard 58 is pivoted upwardly until film 62 contacts wire 60.

As wire 60 is heated it expands and tends to sag. It is important therefore to maintain tension on wire 60 throughout its heating and cooling cycle. This is accomplished, as shown in FIG. 11, by mounting heating wire 60 around the rounded ends of two spring levers or leaf springs 90. Springs 90 are fastened to associated mounting plates 92 so they are capable of movement toward each other against internal biasing forces. Plates 92 are mounted to the top housing 40 at either side thereof. Wire 60 is kept under slight spring tension so that as it expands, springs 90 take up the slack.

As shown in FIG. 12, switch 63 controls the application of power from a power supply 94 to heating wire 60. Springs 90 are two coil springs 96 mounted at either end of wire 60. The power supply 94 is a battery.

Alternatively, as shown in FIG. 13, a power supply 98 consisting of a step-down transformer 97 provides an output of 12 volts of alternating current connected across wire 60 as shown in A pair of leaf springs 99 bias the heating wire 60 so as to take up any slack from expansion during heating.

In operation, the top and bottom housings 40 and 10, respectively, are separated by depressing catches 26. Assuming the top housing 40 is affixed to the underside of a horizontal mounting surface, once catches 26 are depressed, the front of the lower housing pivots downwardly about rounded rod 45. Brackets 28 are lifted away from rounded rod 45 and the bottom housing removed from tope housing 40. Roll stop 66 is rotated back so it rests on top of the back of housing 10 and a roll of film is placed on plates 16. An edge of the film is withdrawn and laid over ledge 20 and extension 22. The bottom housing 10 is placed back in position so that brackets 28 engage rounded bars 45 and catches 26 snap through openings 46.

Upon lifting the film 62 from film roll 17 guard 58 pivots upwardly until film 62 contacts heating wire 60. At the same time channel 74 pivots so that its back blade presses the film 62 against ledge 20 while cam surface 84 of cam 82 presses upwardly on contact 65 causing current to flow through heating wire 60. Once film 62 is severed by the heated wire 60, its end falls down over extension 22 allowing guard 58 and channel piece 74 to return and open switch 63 to stop the flow of current. The recessed portions 24 of extension 22 allow the film to be grabbed by a user when the next operation is commenced.

Extension 22 ensures that once the film 62 is severed its end hangs down freely over extension without contacting any other parts of the dispenser.

Once film 62 is severed, guard 58 drops down and pushes the severed end of film 62 away from the heating wire 60. This avoids the tendency of the severed end of the film 62 to stick to the wire 60 and cause noxious fumes.

Accordingly, while this invention has been described with reference to illustrative embodiments, this description is not intended to be construed in a limiting sense. Various , modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. A film dispenser, comprising:

a) a housing having side and bottom walls, a film roll receptacle for receiving a film roll and a ledge forwardly of said receptacle;

b) a heating wire mounted transverse to the direction of movement of film from said film roll when mounted in said film roll receptacle;

c) a power supply having output lines in series with said heating wire;

d) a switch mounted on said housing in series with said power supply and said heating wire and operative upon closing to permit the passage of electrical current through said wire; and, e) an elongated member having pivot means for pivotally mounting said member to the housing, said pivot means being slidably movable in an elongated slot, wherein, in response to pulling up film from said film roll, said elongated member pivotally moves from a rest position to pinch the film against said housing, and, after severing of the film by said wire, said elongated member releases the film and returns to said rest position.

2. A dispenser according to claim 1, wherein said film roll receptacle includes a bottom inclined downwardly and forwardly and means for blocking forward movement of said film roll so as to stop forward rolling of said roll such that film from the roll may be pulled forwardly.

3. A dispenser according to claim 1, wherein said elongated member has a downwardly depending elongated side edge and is suspended at a rear end and in response to pressure from the film being lifted, pivots so that said side edge pinches the film against the ledge whilst a front of said member moves upwardly causing said switch controlling current through said heating wire to close.

4. A dispenser according to claim 1, wherein said switch opens upon movement of said elongated member back towards its rest position.

5. A dispenser according to claim 1, wherein said wire is mounted over two springs located at respective sides of said housing.

6. A dispenser according to claim 1, further comprising a guard mounted to said housing so as to cover said heating wire and movable upwardly so as to expose said heating wire in response to force exerted by said film, wherein said guard is positioned such that upon severance of the film, it moves downwardly and pushes the severed film off of the wire.

7. A dispenser according to claim 1, wherein said housing has a top housing and a bottom housing with the ledge and the film receptacle affixed to said bottom housing and locking means for releasably locking said top and bottom housings together.

8. A film dispenser, comprising:

a) a bottom housing having a film roll receptacle with a forwardly and downwardly inclined bottom and a ledge positionable in front of said film roll receptacle to block forward movement of a rill of film;

b) a top housing pivotally coupled to a rear of said bottom housing and having catch means for locking a front thereof to said bottom housing;

c) means for causing increased resistance to pulling out of said film in response to lifting of an end of the film upwardly;

d) a heating wire suspended from said top housing transverse to movement of said film;

e) a switch coupled to said top housing above said causing means for switching an electrical current on and off through said wire in response to upward lifting and downward movement of the film, respectively; and f) a guard enclosing said heating wire, and movable upwardly so as to expose the wire, and to return after severance of the film to push the severed end of the film of the heating wire, wherein said increased resistance causing means is an elongated member having a downwardly depending side edge suspended at a rear end from a centrally located pin received in an elongated slot.

9. A dispenser according to claim 8, wherein said ledge includes a downwardly and forwardly inclined extension positioned so that an end of the film after severance falls onto said extension so as to avoid contact with any other parts on said dispenser.

10. A dispenser according to claim 9, wherein said extension has a pair of recesses so as to permit gripping of the severed end of the film by a user.

* * * * *